US008262160B2

(12) United States Patent
Mafi et al.

(10) Patent No.: US 8,262,160 B2
(45) Date of Patent: Sep. 11, 2012

(54) ADJUSTABLE PADDED CHAIR

(76) Inventors: Mehri Mafi, San Jose, CA (US); Maryam Mafi, San Jose, CA (US)

( * ) Notice: Subject to any disclaimer, the term of this patent is extended or adjusted under 35 U.S.C. 154(b) by 759 days.

(21) Appl. No.: 12/271,684

(22) Filed: Nov. 14, 2008

(65) Prior Publication Data

US 2010/0122408 A1 May 20, 2010

(51) Int. Cl.
*A47C 31/00* (2006.01)

(52) U.S. Cl. ..... 297/219.1; 297/229; 297/256.16; 297/452.41; 297/452.46; 4/580; 4/583

(58) Field of Classification Search ..... 297/219.1, 297/229, 256.16, 452.41, 452.46; 4/580, 4/583

See application file for complete search history.

(56) References Cited

U.S. PATENT DOCUMENTS

| | | | | |
|---|---|---|---|---|
| 585,834 | A | 7/1897 | Ruth | |
| 2,260,437 | A * | 10/1941 | Chambers | 5/653 |
| 2,264,672 | A | 12/1941 | Levine | |
| 2,437,602 | A * | 3/1948 | Hann | 267/117 |
| 2,504,646 | A | 4/1950 | Burrow | |
| 2,541,029 | A | 2/1951 | Burton | |
| 2,582,439 | A * | 1/1952 | Kavanagh | 297/396 |
| 2,672,628 | A | 3/1954 | Spanel | |
| 2,822,553 | A | 2/1958 | Florentine | |
| 3,058,122 | A | 10/1962 | McDaniel et al. | |
| 3,112,956 | A * | 12/1963 | Schick et al. | 297/219.1 |
| 3,253,861 | A * | 5/1966 | Howard | 297/452.43 |
| 3,276,047 | A * | 10/1966 | Emery | 5/654 |
| 3,296,635 | A * | 1/1967 | O'Hanlan | 5/654 |
| 3,574,873 | A | 4/1971 | Weinstein | |
| 3,748,669 | A | 7/1973 | Warner | |
| 3,892,000 | A | 7/1975 | Morse | |
| 3,909,859 | A | 10/1975 | Harris | |
| 3,931,652 | A | 1/1976 | Navarra | |
| 3,961,380 | A | 6/1976 | Garr | |
| 4,008,498 | A | 2/1977 | Thomas | |
| 4,037,591 | A | 7/1977 | Sarno | |
| 4,051,563 | A | 10/1977 | Clarke, Jr. | |
| 4,254,517 | A | 3/1981 | Herman, Jr. | |
| 4,411,033 | A | 10/1983 | Morgan | |
| 4,459,714 | A * | 7/1984 | Lin | 5/655.3 |
| 4,511,621 | A | 4/1985 | Thomas et al. | |
| 4,737,998 | A | 4/1988 | Johnson, Sr. | |

(Continued)

FOREIGN PATENT DOCUMENTS

GB 2099296 A 12/1982

(Continued)

OTHER PUBLICATIONS

Mardan, et al., Specification and drawings of U.S. Appl. No. 10/646,946, filed Aug. 22, 2003, entitled "Water Bed for a Bathtub" (abandoned), 15 pgs.

(Continued)

*Primary Examiner* — Laurie Cranmer

(74) *Attorney, Agent, or Firm* — Blakely, Sokoloff, Taylor & Zafman LLP

(57) ABSTRACT

A padded seat is described that includes a top surface, a bottom surface, a compartment disposed between the top surface and the bottom surface, a closeable opening to fill the compartment with a fluid, a plurality of through holes which pass through the top surface, compartment, and bottom surface, and a non-slip element disposed on the top surface.

15 Claims, 5 Drawing Sheets

U.S. PATENT DOCUMENTS 4,744,112 A 5/1988 Keesling, Jr.
4,860,805 A 8/1989 Townsend
4,912,789 A 4/1990 Maxwell
4,934,013 A 6/1990 Jacoby
4,964,183 A 10/1990 LaForce, Jr.
5,020,168 A 6/1991 Wood
5,050,591 A 9/1991 Sandrin
5,077,848 A 1/1992 McDaniel et al.
5,086,528 A 2/1992 Miller
5,113,540 A * 5/1992 Sereboff ..... 5/654
5,144,703 A 9/1992 Maire
5,173,346 A 12/1992 Middleton
5,247,712 A 9/1993 Williams
D343,980 S 2/1994 Torchia
D345,278 S 3/1994 Hamilton et al.
5,322,345 A * 6/1994 Desser et al. ..... 297/214
5,335,377 A * 8/1994 Masyada et al. ..... 4/578.1
5,345,622 A 9/1994 Plone
5,395,162 A * 3/1995 Jay et al. ..... 297/452.25
5,421,043 A 6/1995 McDaniel et al.
D359,870 S 7/1995 McLaughlin
5,429,852 A * 7/1995 Quinn ..... 428/71
5,507,048 A 4/1996 Hauser et al.
5,548,851 A 8/1996 Wien et al.
D383,834 S 9/1997 Frankel
5,669,660 A * 9/1997 Matthies ..... 297/195.13
5,829,070 A 11/1998 Taylor
5,839,132 A 11/1998 Rooney
5,868,463 A * 2/1999 MacKenzie et al. ..... 297/228.12
D407,785 S 4/1999 Scheurer
6,044,506 A 4/2000 Valene
6,085,367 A 7/2000 Guiste
6,206,474 B1 * 3/2001 Kruse et al. ..... 297/452.41
D443,686 S 6/2001 Gonzalez
6,336,231 B1 1/2002 Smith
6,357,061 B1 3/2002 Gonzalez
6,378,147 B1 4/2002 Halleran
6,453,485 B2 * 9/2002 Bullock ..... 4/580
6,691,337 B1 2/2004 Banks
6,752,773 B2 6/2004 Leung et al.
6,929,325 B1 * 8/2005 Goelo ..... 297/219.1
6,957,865 B1 * 10/2005 Adams et al. ..... 297/344.12
7,140,056 B2 * 11/2006 Deering ..... 5/644
7,207,627 B2 * 4/2007 Jerome ..... 297/219.1
7,234,770 B1 * 6/2007 Schiebl ..... 297/219.1
7,454,807 B1 * 11/2008 Mardan et al. ..... 5/654
7,549,702 B2 * 6/2009 Meyers ..... 297/344.18
7,963,613 B2 * 6/2011 Felmeri ..... 297/440.22
2001/0034907 A1 11/2001 Bullock
2003/0024042 A1 2/2003 Leung et al.
2003/0131407 A1 7/2003 Gutierrez et al.
2004/0070238 A1 * 4/2004 Moser et al. ..... 297/183.9
2004/0107495 A1 6/2004 Pleym
2008/0134428 A1 * 6/2008 Call ..... 4/566.1
2008/0196154 A1 * 8/2008 Felmeri ..... 4/579

FOREIGN PATENT DOCUMENTS

GB 2154447 A 9/1985

OTHER PUBLICATIONS

U.S. Appl. No. 10/646,946, Office Action mailed Dec. 10, 2004, 11 pgs.
Mardan, et al., Specification and drawings of U.S. Appl. No. 29/200,584, filed Mar. 2, 2004, entitled "Water Bed for a Bathtub" (abandoned), 3 pgs.
U.S. Appl. No. 29/200,584 (abandoned) Office Action mailed Jan. 4, 2006, 9 pgs.

* cited by examiner

D-D

ADJUSTABLE PADDED CHAIR

FIELD

Embodiments of the present invention relate generally to an adjustable padded chair. More particularly, these embodiments relate to a fluid-filled, padded chair that can be used in a shower or bath.

BACKGROUND

Bathing can be a difficult and uncomfortable task for elderly, physically disabled persons, as well as others experiencing bodily pain and limitations in mobility. Numerous padded bathtub liners have been described in the prior art and, although they may be suitable for the purposes to which they address, they differ from embodiments of the present invention.

SUMMARY

A padded seat is described that is filled with a fluid and includes non-slip elements disposed on the top surface and a plurality of through holes that pass through the top surface, fluid filled compartment, and bottom surface. For one embodiment, the padded seat includes a plurality of fluidly interconnected sub-compartments that restrict the flow of fluid between the sub-compartments. For one embodiment a plurality of massage elements are disposed throughout the fluid filled compartment.

An adjustable chair with arms elevated above the seat of the chair is also described, wherein a padded seat is detachably coupled to the seat of the chair. For one embodiment, the seat of the chair has a plurality of through holes. For one embodiment, the padded seat is detachably coupled to the seat of the chair by a plurality of suction cups disposed on the bottom surface of the padded seat. For one embodiment, the seat of the chair has a decline in elevation from the front to the rear and elevated edges on the sides and rear of the seat to restrict movement of the padded seat portion.

Other features and advantages of embodiments of the present invention will be apparent from the accompanying drawings and from the detailed description that follows.

BRIEF DESCRIPTION OF THE DRAWINGS

Embodiments of the present invention are illustrated by way of example and not limitation in the figures of the accompanying drawings, in which like references indicate similar elements, and in which.

DETAILED DESCRIPTION

Embodiments of a padded seat are described. The padded seat is filled with a fluid and includes non-slip elements disposed on the top surface and a plurality of through holes that pass through the top surface, fluid filled compartment, and bottom surface. An adjustable chair with arms elevated above the seat of the chair is also described, wherein a padded seat is detachably coupled to the seat of the chair.

Figure 1:
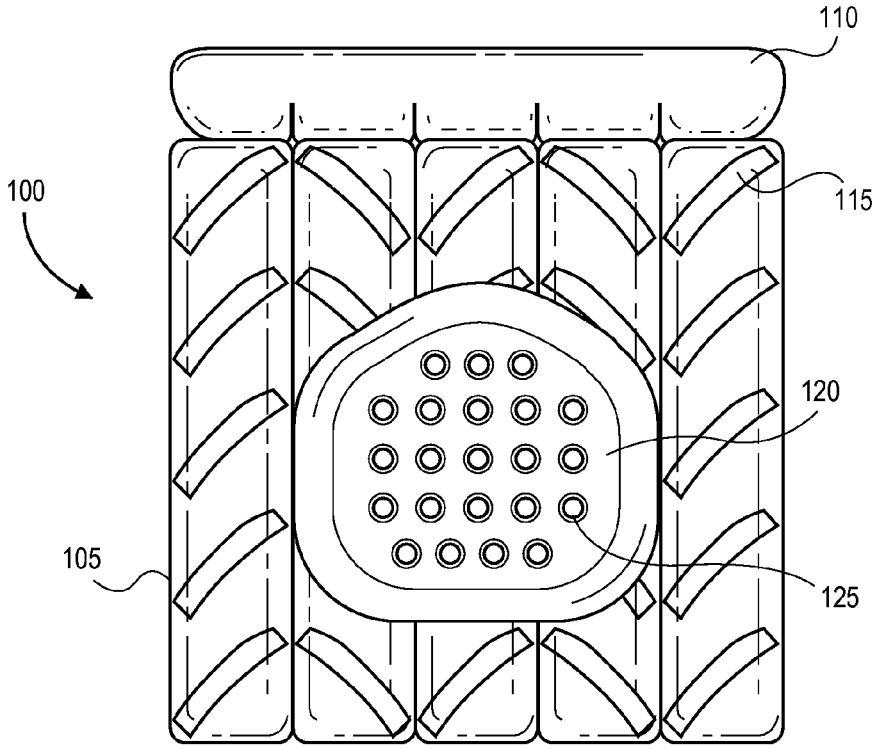
FIG. 1 shows a top view of a padded seat according to one embodiment of the invention.

FIG. 1 shows a top view of a padded seat 100. For one embodiment, padded seat 100 is comprised of a plastic, rubber, latex, other material suitable for use as a waterproof, fluidly inflatable body, or a combination thereof. For one embodiment, padded seat 100 is comprised of a series of adjacent, inverted U-shaped members 105. The adjacent, inverted U-shaped members 105 are formed by a common top surface of the padded seat 100.

For one embodiment, the padded seat 100 includes a backrest 110. The backrest 110 is an extension of the padded seat as described above, sharing a common top surface. The backrest 110 is distinguished from the remainder of the padded seat 100 by a thinner portion of the fluidly inflatable body that allows the entire padded seat to fold at the backrest 110. The fold allows the backrest 110 to maintain a position at or near perpendicular to the remainder of the padded seat 100. For one embodiment, the backrest 110 is formed in a position at or near perpendicular to the remainder of the padded seat 100 without a fold. For an alternative embodiment, backrest 110 is separate fluidly inflatable body coupled to padded seat 100.

For one embodiment, the backrest 110 provides support for a lower portion of the back of the user but not an upper portion of the back of a user. The height of backrest 110 is low enough as to not interfere with the pivoting of a torso of the user. For one embodiment, the backrest 110 is less than or equal to one foot in height.

One or more non-slip elements 115 are disposed on the top surface and prevent the user (not shown) from easily sliding across the surface of padded seat 100. For one embodiment, non-slip elements 115 have a soft, textured surface to provide friction without irritating the skin of the user.

The top surface of padded seat 100 includes a concave portion 120. The concave portion 120 has one or more through holes 125 to allow fluid to pass through the top surface, body, and bottom surface of the padded seat 100. For one embodiment, through holes 125 prevent water from pooling around a seated user. For one embodiment, the through holes 125 are not limited to the concave portion 120 and disposed throughout the body of the padded seat 100, for example, along the seams where the adjacent, inverted U-shaped members 105 meet.

Figure 2:
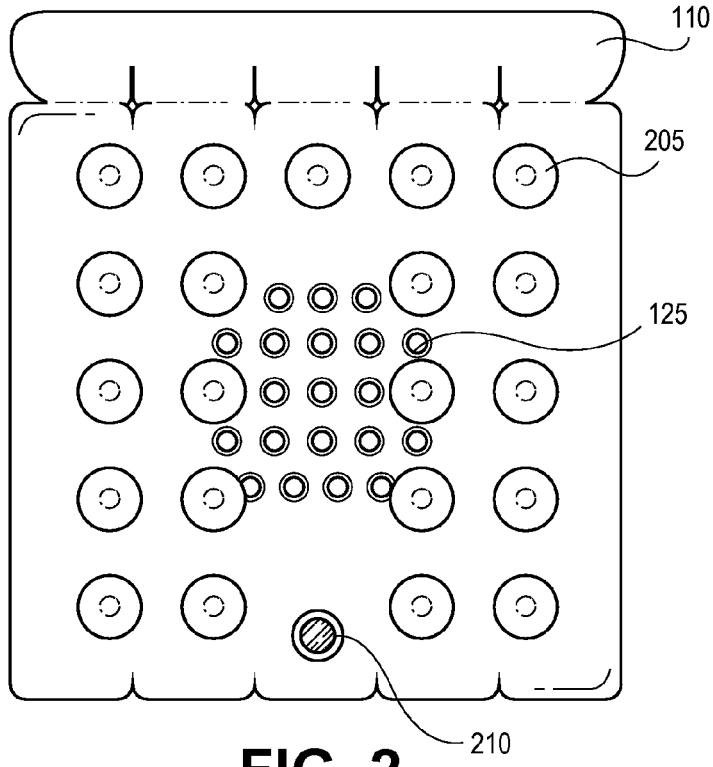
FIG. 2 shows a bottom view of a padded seat according to one embodiment of the invention.

FIG. 2 shows a bottom view of the padded seat 100 including the backrest 110 and through holes 125. One or more gripper elements 205 are disposed on the bottom surface of the padded seat 100. For one embodiment, gripper elements 205 are disposed on the back of the backrest 110 as well (not shown). For one embodiment, gripper elements 205 are suction cups coupled to the bottom surface of the padded seat 100. Gripper elements 205 allow the padded seat to be detachably coupled to a surface. For example, the gripper elements 205 can be detachably coupled to the surface of a bathtub, a built-in seat in a shower, a stool, a chair, or other support structure suitable for the use of sitting. Gripper elements 205 restrict the padded seat 100 from moving across a surface.

A valve 210 is disposed in the bottom surface to allow for filling and draining of fluid from the body of the padded seat 100. For one embodiment, the padded seat 100 is filled with one or more of the following: water, gel, air, other fluid suitable for filling an inflatable body, or combination thereof. For one embodiment, valve 210 is configured to receive a filler device (not shown). For example, a filler device is a hose configured to mate with a showerhead, bath spout, or sink spout on one end and the valve 210 on the other end. In an alternative embodiment, the valve 210 is positioned on another surface of the padded seat 100—for example, the top surface or one of the sides.

Figure 3:
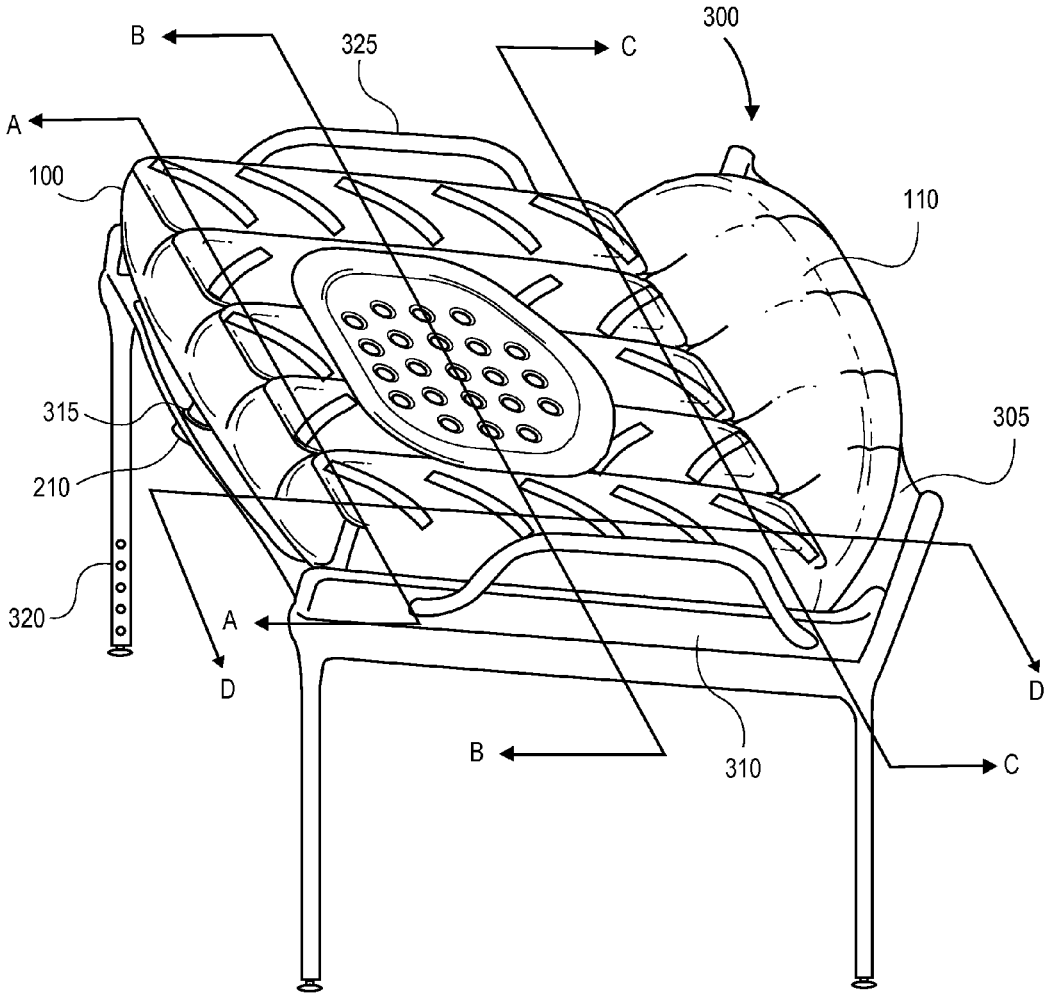
FIG. 3 shows a perspective view of a padded seat detachably coupled to a chair according to one embodiment of the invention.

FIG. 3 shows a perspective view of the padded seat 100 detachably coupled to a chair 300. Chair 300 has a backrest 305. For one embodiment, the backrest 305 provides support for a lower portion of the back of the user but not an upper portion of the back of a user. The height of backrest 305 is low enough as to not interfere with the pivoting of a torso of the user. For one embodiment, the backrest 305 is less than or equal to one foot in height.

For one embodiment, chair 300 has a slight decline from the front towards the back to restrict the padded seat 100 from sliding forward. The backrest 305 restricts the padded seat 100 from sliding backwards on the seat surface of the chair 300. Elevated edges 310 are disposed on either side of the seat surface of the chair 300 and restrict the padded seat 100 from sliding from side to side. For one embodiment, the chair 300 has no backrest 305 and, instead, has an elevated edge disposed on the back of the seat surface (similar to elevated edges 310) to prevent the padded seat from sliding backwards on the chair 300. In an alternative embodiment, the seat surface of the chair 300 is level (with respect to the surface upon which it stands) and gripper elements 205 alone restrict the padded seat 100 from sliding around the surface of the chair 300.

The chair 300 has a through hole 315 to allow valve 210 to extend below the bottom surface of the padded seat 100 and seat surface of chair 300. For one embodiment, the chair 300 has a cut out or other means to allow the valve 210 extend below the bottom surface of the padded seat 100 unencumbered.

The chair 300 has one or more legs 320. For one embodiment, legs 320 are adjustable in height and have a telescoping inner support that is locked into position by means of a spring-loaded pin. For an alternative embodiment legs 320 are adjustable according to another technique known in the art.

Arms 325 are disposed on either side of the chair 300. The arms 325 provide support when a user is in the act of sitting down or standing up. The arms 325 are disposed at an elevation above the surface of the seat of the chair 300 and the padded seat 100 so that a user may easily grasp them. For one embodiment, the arms 325 are adjustable in height.

Figure 4A:
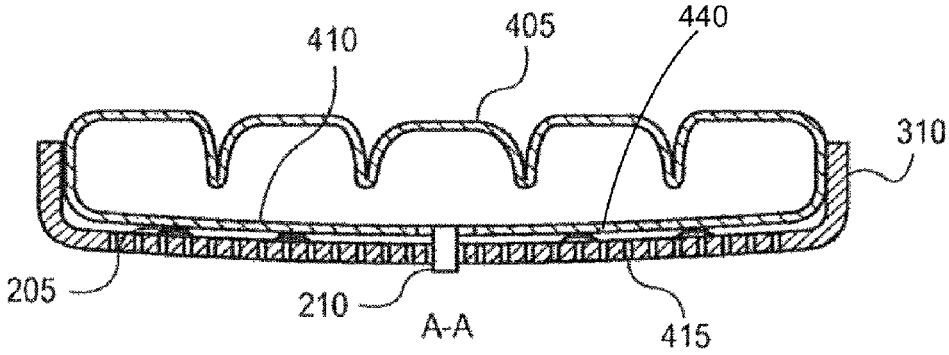
FIG. 4A shows a cross-sectional view of a padded seat and chair of the FIG. 3, at the cross-section labeled A, according to one embodiment of the invention.

FIG. 4A shows a cross-sectional view of the padded seat 100 and a portion of the chair 300 of the FIG. 3, at the cross-section labeled A. The gripper elements 205 are coupled to the seat surface of the chair 300. Elevated edges 310 assist gripper elements 205 in restricting movement of the padded seat 100 on the chair 300. The valve 210 passes through the chair 300.

The top surface 405 is shown as a series of adjacent, inverted U-shaped undulations. For one embodiment, each inverted U-shape couples to the bottom surface 410 of the padded seat 100, which is described in detail below in reference to FIG. 5.

The bottom surface 410 comprises the same material as the top surface 405, as described herein with reference to FIG. 1. For one embodiment, an insulating material 440 is disposed on (not shown) or combined with (as illustrated) the bottom surface 410 to restrict change in temperature of the fluid within the padded seat 100. Various fiber or foam insulation materials can be used without exceeding the scope of this embodiment.

A plurality of through holes 415 is disposed in the seat surface of the chair 300. The through holes 415 allow fluid to pass through the surface of the chair 300, thus, for example, preventing water from pooling on the surface of the chair 300.

Figure 4B:
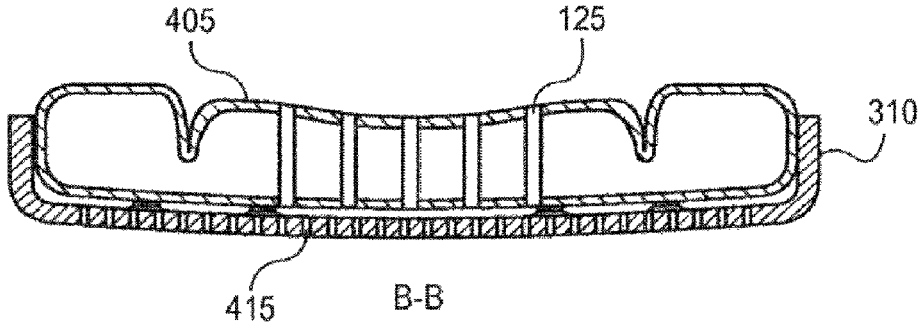
FIG. 4B shows a cross-sectional view of a padded seat and chair of FIG. 3, at the cross-section labeled B, according to one embodiment of the invention.

FIG. 4B shows a cross-sectional view of the padded seat 100 and a portion of the chair 300 of FIG. 3, at the cross-section labeled B. The top surface 405 has a lower elevation in the center than on the sides and the front (i.e., the center of top surface 405 in FIG. 4A). This decrease in elevation towards the middle of the padded seat 100 forms the aforementioned concave portion 120. The through holes 125 that pass through the body of the padded seat 100 (as described above with reference to FIG. 1) are shown in the concave portion 120 and work in cooperation with the through holes 415 of the chair 300.

Figure 4C:
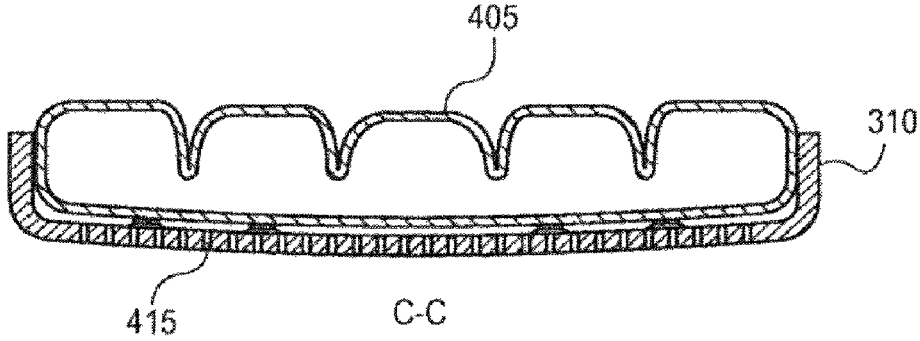
FIG. 4C shows a cross-sectional view of a padded seat and chair of FIG. 3, at the cross-section labeled C, according to one embodiment of the invention.

FIG. 4C shows a cross-sectional view of the padded seat 100 and a portion of the chair 300 of FIG. 3, at the cross-section labeled C. This cross-sectional view is similar to that of FIG. 4A. The top surface 405 has increased in height in the middle, further forming the concave portion 120.

Figure 4D:
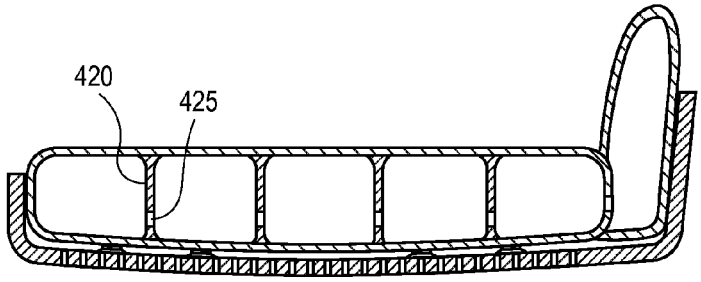
FIG. 4D shows a cross-sectional view of a padded seat and chair of FIG. 3, at the cross-section labeled D, according to one embodiment of the invention.

FIG. 4D shows a cross-sectional view of the padded seat 100 and a portion of the chair 300 of FIG. 3, at the cross-section labeled D. For one embodiment, the interior compartment of the padded seat 100 is divided into a plurality of fluidly interconnected sub-compartments. The sub-compartments are defined by walls 420, which restrict the flow of fluid around the body of the padded seat 100. Walls 420 have one or more bore holes 425 to allow some movement of fluid between sub-compartments.

Figure 5:
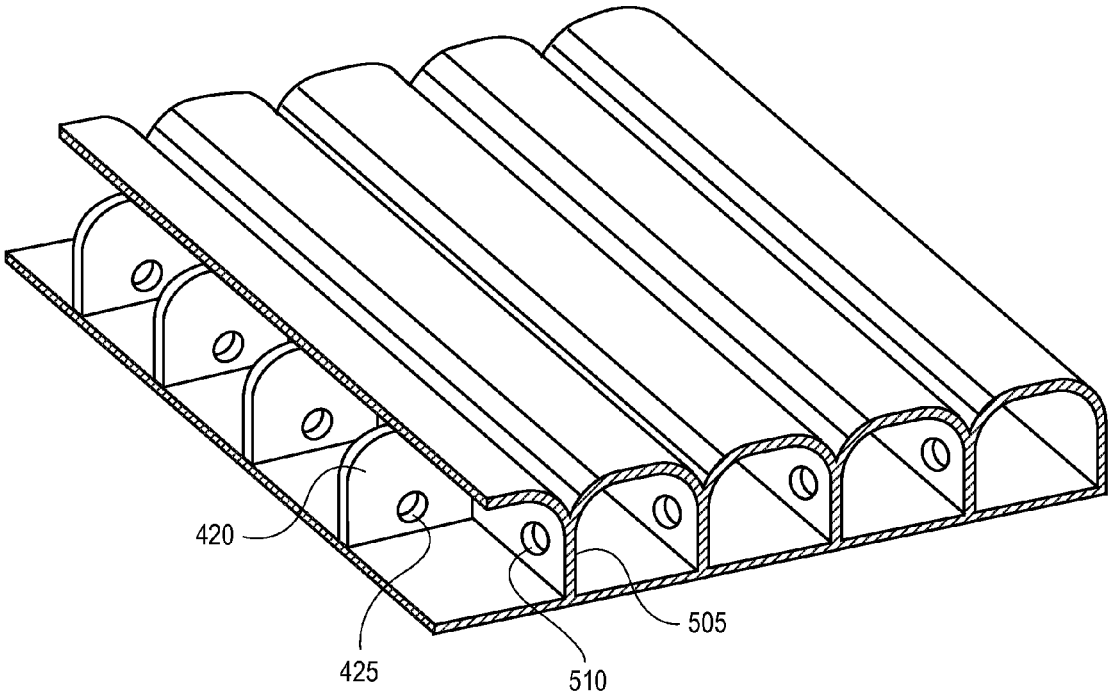
FIG. 5 shows a partial, perspective view of a cross-section of a padded seat with a portion of the top surface removed, according to one embodiment of the invention.

FIG. 5 shows a partial, perspective view of a cross-section of the padded seat 100 with a portion of the top surface removed. The inverted U-shaped top surface 505 couples to the bottom surface on both sides of the inverted U. In a similar fashion to walls 420 with bore holes 425, the top surface 505 also has bore holes 510 to allow for restricted movement of fluid between sub-compartments.

Figure 6:
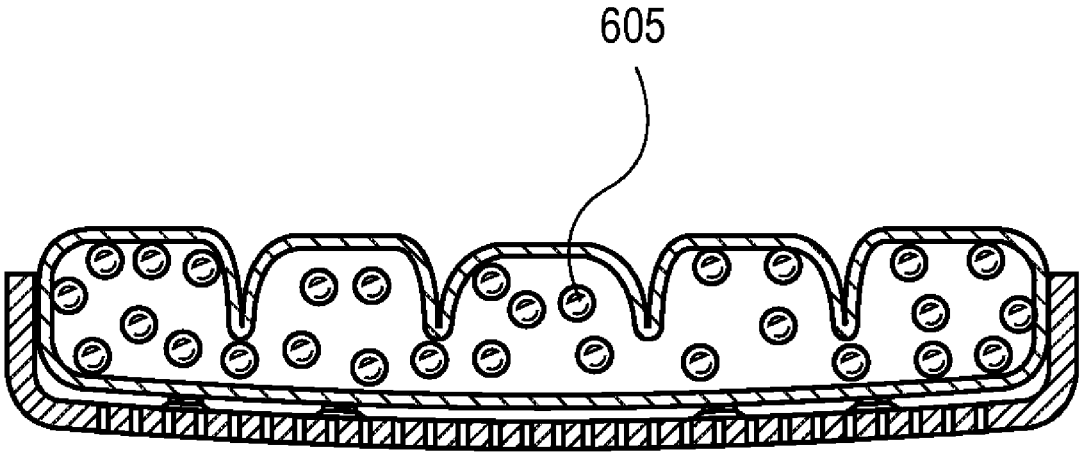
FIG. 6 shows a cross-sectional view of a padded seat and chair with a plurality of massage elements disposed throughout the compartment of the padded seat, according to one embodiment of the invention.

FIG. 6 shows a cross-sectional view of the padded seat 100 and a portion of the chair 300 with a plurality of massage elements 605 disposed throughout the compartment of the padded seat 100. For one embodiment, the massage elements 605 are composed of a soft rubber material. For an alternative embodiment, the massage elements 605 are composed of a gel material enclosed in a flexible, liquid-proof shell. For one embodiment, bore holes 425 and 510 are large enough to allow the massage elements 605 to pass between sub-compartments.

In the foregoing specification, the invention has been described with reference to specific exemplary embodiments thereof. It will be evident that various modifications may be made thereto without departing from the broader spirit and scope of the invention. The specification and drawings are, accordingly, to be regarded in an illustrative sense rather than a restrictive sense.

What is claimed is:

1. A padded seat comprising:

a top surface;

a bottom surface;

a compartment disposed between the top surface and the bottom surface, wherein the compartment comprises a plurality of fluidly interconnected sub-compartments, the sub-compartments defined by walls with one or more bore holes that allow a restricted flow of a fluid between the sub-compartments;

a plurality of massage elements disposed throughout the compartment, wherein the massage elements are of a size to enable the massage elements to pass through the one or more bore holes between the sub-compartments;

a closeable opening to fill the compartment with the fluid;

a plurality of through holes which pass through the top surface, compartment, and bottom surface; and a non-slip element disposed on the top surface.

2. The padded seat of claim 1, wherein a portion of the top surface is concave and the plurality of through holes are located in a lower section of the concave portion.

3. The padded seat of claim 1, wherein the top surface comprises a series of adjacent inverted U-shaped members.

4. The padded seat of claim 1, wherein the bottom surface comprises an insulation layer to restrict heat transfer and restrict a change in temperature of the fluid within the compartment.

5. The padded seat of claim 1, further comprising:

a backrest section having a top surface, a bottom surface, and a compartment disposed between the top surface and the bottom surface, wherein the compartment of the backrest section is fluidly coupled to the compartment of the padded seat.

6. The padded seat of claim 5, wherein the backrest is less than or equal to one foot in height.

7. The padded seat of claim 1, wherein the fluid is water.

8. The padded seat of claim 1, wherein the fluid is a gel.

9. A chair comprising:

a padded seat having a top surface;

a bottom surface;

a compartment disposed between the top surface and the bottom surface, wherein the compartment comprises a plurality of fluidly interconnected sub-compartments, the sub-compartments defined by walls with one or more bore holes that allow a restricted flow of a fluid between the sub-compartments;

a plurality of massage elements disposed throughout the compartment, wherein the massage elements are of a size to enable the massage elements to pass through the one or more bore holes between the sub-compartments;

a closeable opening to fill the compartment with the fluid;

a plurality of through holes which pass through the top surface, compartment, and bottom surface; and a support having one or more legs, a seat, and arms on opposite sides of the seat, wherein the arms are elevated above the seat, and wherein the padded seat is detachably coupled with the support.

10. The chair of claim 9, wherein the padded seat is detachably coupled with the support by a plurality of suction cups disposed on the bottom surface of the padded seat.

11. The chair of claim 9, wherein the support further includes a backrest and the padded seat further includes a padded backrest section.

12. The chair of claim 11, wherein the backrests of the padded seat and support are less than or equal to one foot in height.

13. The chair of claim 9, wherein the one or more legs are adjustable in height.

14. The chair of claim 9, wherein the seat of the support has a plurality of through holes.

15. The chair of claim 9, wherein the support has a front, a rear, and two sides, the seat of the support portion having an decline in elevation from the front to the rear and elevated edges on the sides and rear of the seat to restrict movement of the padded seat portion in conjunction with a plurality of gripper elements disposed on the bottom surface of the padded seat.

* * * * *